US005666144A

United States Patent [19]

Zhang

[11] Patent Number: 5,666,144

[45] Date of Patent: Sep. 9, 1997

[54] INK DROPLET JET DEVICE HAVING SEGMENTED PIEZOELECTRIC INK CHAMBERS WITH DIFFERENT POLARIZATION

[75] Inventor: Qiming Zhang, Beverly, Mass.

[73] Assignee: Brother Kogyo Kabushiki Kaisha, Nagoya, Japan

[21] Appl. No.: 246,268

[22] Filed: May 19, 1994

[30] Foreign Application Priority Data

May 26, 1993 [JP] Japan ..... 5-123862

[51] Int. Cl.[6] ..... B41J 2/045

[52] U.S. Cl. ..... 347/69; 347/68; 310/333; 310/359

[58] Field of Search ..... 347/68, 69, 71, 347/92, 94; 310/330, 333, 357, 359

[56] References Cited

U.S. PATENT DOCUMENTS

| | | | |
|---|---|---|---|
| 2,540,194 | 2/1951 | Ellett | 310/359 X |
| 3,659,127 | 4/1972 | Kumon | 310/359 |
| 3,842,294 | 10/1974 | Doi et al. | 310/333 |
| 3,946,398 | 3/1976 | Kyser et al. | 347/68 |
| 4,336,510 | 6/1982 | Miyamori | 310/357 X |
| 4,503,352 | 3/1985 | Inoue | 310/359 |
| 4,723,129 | 2/1988 | Endo et al. | 347/56 |
| 4,825,227 | 4/1989 | Fischberg et al. | 347/69 |
| 4,879,568 | 11/1989 | Bartky et al. | 347/69 |
| 4,887,100 | 12/1989 | Michaelis et al. | 347/69 |
| 5,016,028 | 5/1991 | Temple | 347/69 |
| 5,252,994 | 10/1993 | Narita et al. | 347/69 X |

FOREIGN PATENT DOCUMENTS

| | | | |
|---|---|---|---|
| 60-216615 | 10/1985 | Japan | 310/359 |
| 4-284253 | 10/1992 | Japan . | |

*Primary Examiner*—Huan H. Tran
*Assistant Examiner*—Charlene Dickens
*Attorney, Agent, or Firm*—Oliff & Berridge

[57] ABSTRACT

An ink droplet jet device having a piezoelectric ceramic plate is provided with ink chambers having partitions. The front half of each partition is opposite to the rear half in the direction of polarization. When a voltage is applied to the electrodes of a given partition, the front and the rear half thereof deform in the opposite directions because of their inverse directions of polarization. This prevents the introduction of air through the nozzles into the ink chambers adjacent to the activated ink chamber and the speed of printing is increased.

17 Claims, 7 Drawing Sheets

Fig.3(A)
DRIVING WAVE FORM [4B]
Fig.3(B)
PRESSURE NEAR NOZZLE [4B]
Fig.3(C)
PRESSURE NEAR NOZZLE [4C]
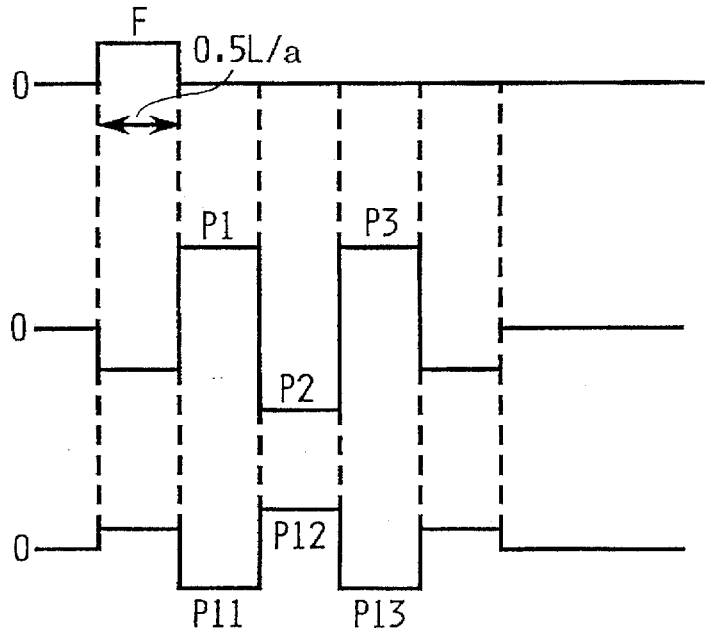
Fig.4
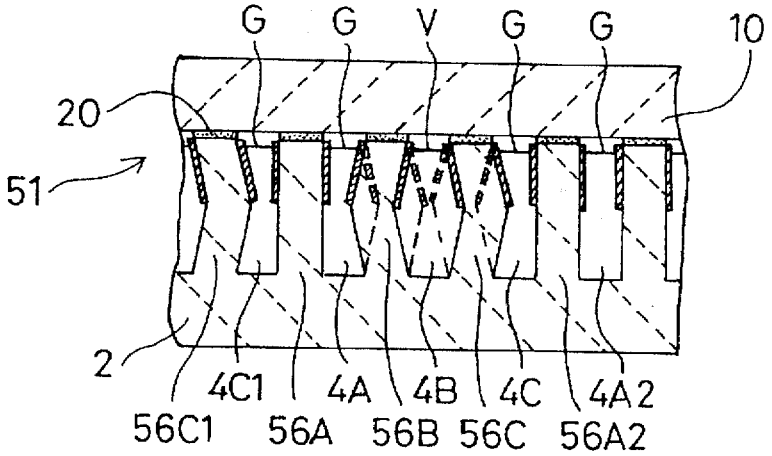
Fig.5
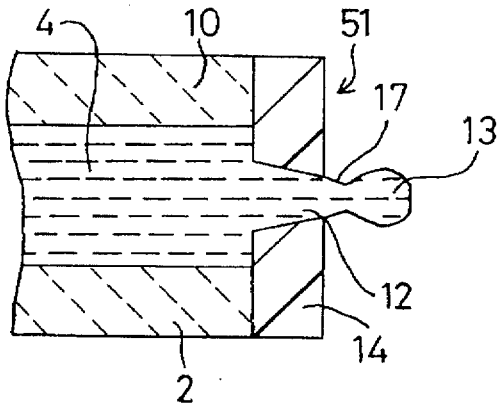

Fig.10(A)
PRIOR ART
Fig.10(B)
PRIOR ART
Fig.10(C)
PRIOR ART
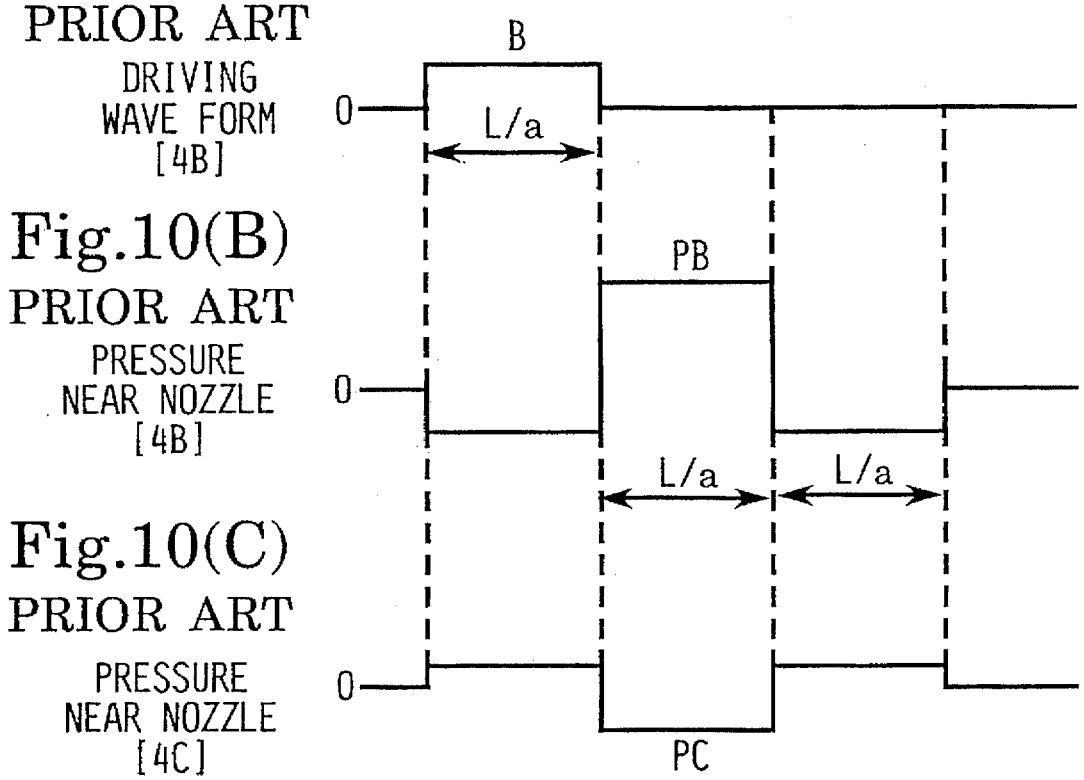
Fig.11
PRIOR ART
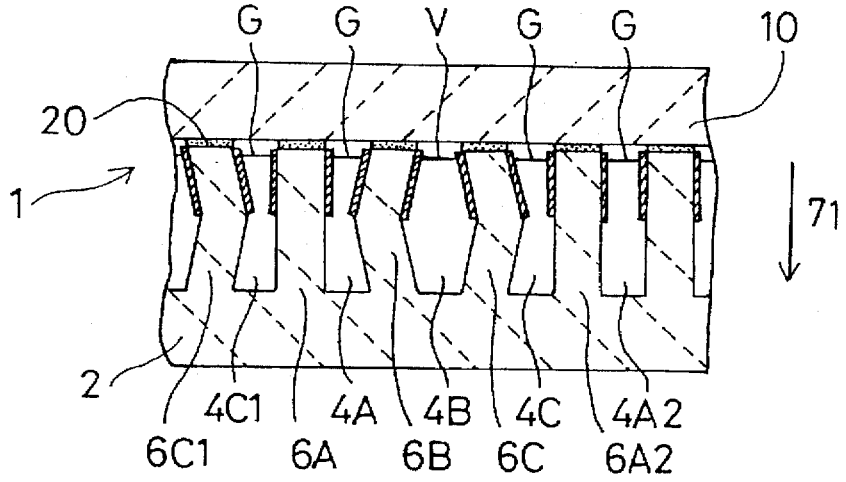

INK DROPLET JET DEVICE HAVING SEGMENTED PIEZOELECTRIC INK CHAMBERS WITH DIFFERENT POLARIZATION

BACKGROUND OF THE INVENTION

1. Field of the Invention

The invention relates to an ink droplet jet device wherein partitions made of piezoelectric elements and constituting ink chambers are deformed to apply pressure to the ink therein so that ink droplets are jetted out through nozzles corresponding to the chambers.

2. Description of Related Art

Among many non-impact printers that are today replacing conventional impact printers, the ink jet printer is drawing attention because of its simplest-ever principle of operation and its ability to print in multiple gradations and with colors. Of the variations of ink jet printer, the drop-on-demand type is a printer that jets out only the ink droplets to be actually printed. As such, the drop-on-demand type ink jet printer is getting widespread acceptance thanks to its high jetting efficiency and low running cost.

Typical variations of the drop-on-demand type ink jet printer include the Kyser type disclosed in U.S. Pat. No. 3,946,398 and the thermal jet type disclosed in U.S. Pat. No. 4,723,129. Both types have formidable problems to be overcome: the Kyser type is difficult to manufacture in a small size, while the thermal jet type requires the ink to be capable of withstanding the high temperature applied to it.

One solution to the above problems is the shear mode type ink jet printer disclosed in U.S. Pat. Nos. 4,879,568 and 4,887,100. As shown in FIG. 6, a typical shear mode type ink jet printer 1 comprises a piezoelectric ceramic plate 2, a cover plate 10, a nozzle plate 14 and a substrate 41.

The piezoelectric ceramic plate 2 has a plurality of grooves 3 cut therein by a diamond blade or the like. Partitions 6, that separate the grooves 3 laterally, are polarized in a direction indicated by an arrow 5. The grooves 3 all have an identical depth and are in parallel to one another. The shallower the grooves 3 get, the closer they are to one edge 15 of the piezoelectric ceramic plate 2. Near the edge 15 are formed shallow grooves 7. Inside each groove 3, metal electrodes 8 are formed by sputtering or like process over the upper half of the two side walls flanking the groove. The metal electrodes 8 thus furnished over the upper half of the side walls of the grooves 3 are connected electrically by metal electrodes 9 provided in the shallow grooves 7.

The cover plate 10 is composed of a ceramic or plastic resin material. In the cover plate 10 an ink inlet 16 and a manifold 18 are formed by cutting or by grinding. The piezoelectric ceramic plate 2 has the upper surface of the side walls of the grooves 3 bonded by epoxy adhesive 20 (as shown in FIG. 8) to the side of the cover plate 10 where the manifold 18 is formed. With the tops of the grooves 3 thus covered, the ink jet printer 1 has a plurality of ink channels or ink chambers 4 (as shown in FIG. 8) formed laterally at equal intervals. As depicted in FIG. 8, the ink chambers 4 are each of a long, narrow shape having a rectangular cross section. All ink chambers 4 are filled with ink.

As illustrated in FIG. 6, a nozzle plate 14 is attached to the front edge of the piezoelectric ceramic plate 2 and that of the cover plate 10. The nozzle plate 14 has nozzles 12 provided thereon so as to correspond to the positions of the respective ink chambers 4. The nozzle plate 14 is made of such plastic resins as polyalkylene (e.g., ethylene) terephthalate, polyimide, polyether imide, polyether ketone, polyether sulfone, polycarbonate, and cellulose acetate.

The substrate 41 is bonded by an epoxy adhesive or the like to the surface of the piezoelectric ceramic plate 2 which is opposite to the side where the grooves 3 are formed. The substrate 41 has conductive layer patterns 42 formed thereon, the patterns corresponding to the positions of the respective ink chambers 4. The conductive layer patterns 42 and the metal electrodes 9 at the bottom of the shallow grooves 7 are bonded by the use of lead wires 43 furnished through a known wire bonding process.

The structure of a control unit of the ink jet printer 1 of FIG. 6 will now be described with reference to a control unit block diagram of FIG. 7. The conductive layer patterns 42 formed on the substrate 41 are connected individually to an LSI chip 61. Also connected to the LSI chip 61 are a clock line 52, a data line 53, a voltage line 54 and a ground line 55. In keeping with the continuous clock pulses fed from the clock line 52 and according to the data sent over the data line 53, the LSI chip 61 determines through which nozzle 12 an ink droplet is to be jetted. Having selected the nozzle 12, the LSI chip 61 applies a voltage V from the voltage line 54 to the conductive layer pattern 42 connected to the metal electrodes 8 inside the corresponding ink chamber 4 to be activated. The LSI chip 61 applies 0 volt of the ground line 55 to the conductive layer patterns 42 connected to the metal electrodes 8 corresponding to the ink chambers 4 that are left inactive.

An operation of the ink jet printer 1 will now be described with reference to FIGS. 8 and 9. Suppose that given certain data, the LSI chip 61 determines to jet an ink droplet from an ink chamber 4B. The positive driving voltage V is then applied to metal electrodes 8E and 8F, and metal electrodes 8D and 8G are grounded G. As shown in FIG. 9, a partition 6B develops a driving electric field in the direction of an arrow 13B while a partition 6C develops a driving electric field in the direction of an arrow 13C. Because the driving electric field directions 13B and 13C are perpendicular to a direction 5 of polarization, the so-called thickness shear mode effect develops and causes the partitions 6B and 6C to deform rapidly toward the interior of the ink chamber 4B. The deformation of the partitions reduces the volume of the ink chamber 4B to boost the ink pressure therein. The resulting pressure wave causes an ink droplet to be jetted from the nozzle 12 (shown in FIG. 6) corresponding to the ink chamber. 4B.

When the driving voltage V is stopped, the partitions 6B and 6C return to their initial positions (as shown in FIG. 8), thereby gradually reducing the ink pressure inside the ink chamber 4B. The drop in ink pressure causes ink to be supplied into the ink chamber 4B from an ink tank, not shown, via the ink inlet 16 and the manifold 18 (as shown in FIG. 6).

Generally, the efficiency of jetting ink from the ink chamber 4 is enhanced by the setup shown in FIG. 11. With the direction of polarization reversed (i.e., the direction of the arrow 71), a positive voltage is first applied to the partitions 6B and 6C so that they move from each other when deformed. When the application of the voltage is stopped, the partitions 6B and 6C return to their initial positions (FIG. 8) to jet out an ink droplet through the nozzle.

What follows is a description of the behavior of the pressure wave inside the ink chamber 4 when the above driving method is used for the ink jet operation. The description is made specifically with reference to timing charts of FIGS. 10(A) through 10(C) and to a cross-sectional view of the ink jet printer 1 in FIG. 11. A voltage pulse B (FIG. 10(A)) is first applied to the ink chamber 4 to cause an ink droplet to be jetted therefrom. (To apply a voltage V to an ink chamber 4 connotes to apply the voltage V to the electrodes provided to that chamber.) Because the partitions 6 are polarized in the direction of the arrow 71, the partitions 6B and 6C are at first deformed to move away from each other (FIG. 11). The resulting increase in volume of the ink chamber 4B reduces the pressure therein including that in the vicinity of the nozzle 12 (FIG. 10(B)). This state is maintained for a period of L/a shown in FIG. 10(B). During that time, ink is sucked into the chamber through the manifold 18 (FIG. 6).

The period L/a is the time required for the pressure wave inside the ink chamber 4 to propagate one way in the longitudinal direction (from the manifold 18 to the nozzle plate 14 or in the opposite direction). The period L/a is thus determined by the length L of the ink chamber 4 and by the sonic velocity a within the ink.

According to the theory of pressure wave propagation, the pressure inside the ink chamber 4B is reversed exactly L/a after the leading edge of the pulse B; the pressure then shifts from negative to positive in nature. At that point in time, the voltage being applied to the ink chamber 4B reverts to 0 (FIG. 10(A)). This allows the partitions 6B and 6C to return to their initial positions, exerting pressure on the ink. The positive pressure adds up to another pressure generated by the partitions 6B and 6C returning to their initial positions. The result is a relatively high level of pressure (FIG. 10(B)) being applied to the ink inside the ink chamber 4B, whereby an ink droplet is jetted from the nozzle 12.

Where image information is to be presented graphically on a storage medium by the ink jet printer 1 described above, the structure of the printer makes it obvious that adjacent ink chambers 4 cannot jet ink droplets simultaneously. One solution to this bottleneck is the scheme disclosed in U.S. Pat. No. 5,016,028 wherein the ink chambers 4 are grouped into odd-numbered and even-numbered chambers, the two groups being alternated in the ink jet operation. Where there occurs a significant interference (i.e., cross talk) between ink chambers 4, it is proposed that the ink chambers 4 be divided into three or more groups overlapping with one another so that they may be driven in a rotational manner. For example, the ink chambers in the example of FIG. 9 are divided into three groups, chambers 4A and 4D belong to one group, chambers 4B and 4E to another group, and chambers 4C and 4F to a further group.

As shown in FIG. 12, Japanese Laid-Open Patent Publication No. 4-284253 discloses an ink jet printer 90 having electrodes 91A, 91B and 91C formed over each partition 6 and divided in the longitudinal direction thereof. In operation, ink is jetted from the ink chamber by applying a suitable voltage sequentially to the electrodes 91C, 91B and 91A, in that order, to vary the timing at which the partition 6 is deformed in its longitudinal direction.

One disadvantage of the scheme disclosed in U.S. Pat. No. 5,016,028 is as follows: suppose that where the ink chambers are divided into two groups, the ink chamber 4B receives a voltage to have its partitions 6B and 6C deformed. In this setup, the partitions 6B and 6C also act as a partition of the ink chamber 4A and that of the ink chamber 4C, respectively. The partitions 6B and 6C, when deformed to generate a pressure wave in the ink chamber 4B, thus generate pressure waves in the adjacent ink chambers 4A and 4C (FIG. 10(C)) as well. These pressure waves propagate in the ink within the ink chambers 4, are reflected by their side walls, and gradually attenuate while reciprocating inside the chambers 4. Clearly, the fluctuation of the pressure wave in the target ink chamber 4B from which to jet ink and the fluctuation of the pressure wave in the adjacent ink chamber 4C are always opposite in phase and proportional in amplitude. The pressure near the nozzles 12 of the ink chambers 4A and 4C is at first positive in nature at the leading edge of the pulse B and becomes a negative pressure PC upon elapse of L/a; the pressure thereafter reciprocates between positive and negative at intervals of L/a.

Suppose that a high driving voltage pulse B is applied to heighten the pressure PB. inside the ink chamber 4B in order to increase the ink jet velocity. In that case, the negative pressure PC in the adjacent ink chamber 4C increases correspondingly. The boosted negative pressure PC can destroy the meniscus of the nozzle 12, causing air to be introduced through the nozzle 12 into the ink chamber 4C wherein the air bubbles often prevent an ink droplet from being jetted at some future time. In addition, the negative pressure PC occurring for the period of L/a can also cause the meniscus to shift from the nozzle 12 into the ink chamber 4C. This often lets air go through the nozzle 12 into the ink chamber 4C, thereby hampering the normal ink jet operation.

The ink jet printer 90 disclosed in Japanese Patent Laid-Open No. 284253/1992 is complicated in structure because of the divided electrodes 91A, 91B and 91C. The major difficulty is that it takes time to form the three electrodes 91A, 91B and 91C within the narrow groove 3.

SUMMARY OF THE INVENTION

It is therefore an object of the invention to provide an ink droplet jet device which is simply structured and which forestalls the introduction of air through the nozzles of the ink chambers adjacent to the activated ink chamber, whereby printing of high quality is made available.

In carrying out the invention and according to one aspect thereof, there is provided an ink droplet jet device comprising a substrate and a cover plate. The substrate has a plurality of grooves formed thereon. The grooves are separated by partitions made of polarized piezoelectric elements. The cover plate covers the grooves on the substrate to form ink chambers therein. The directions of polarization of the piezoelectric elements constituting the partitions are not uniform in the longitudinal direction of the partitions. Electrodes provided on the substrate to deform the partitions are arranged uniformly in the longitudinal direction of the partitions.

In the ink droplet jet device of the above structure, the partitions made of piezoelectric elements and constituting each ink chamber are not deformed regularly in the longitudinal direction of the ink chamber in question. As a result, the pressure waves generated by different parts of the partitions propagate inside the ink chamber and combine in their different phases near the nozzle, thereby jetting ink droplets from the ink chamber.

The ink droplet jet device of the invention is characterized by the varying directions of polarization of the piezoelectric partitions in the longitudinal direction of the latter. Because different parts of the partitions of the ink chamber in question deform in different directions, the cycle of pressure fluctuation near the nozzle becomes shorter. So does the cycle of pressure fluctuation near the nozzle of an ink chamber adjacent to the activated ink chamber. This in turn shortens the period of negative pressure during which the meniscus of the nozzle can retract into the chamber, whereby the introduction of air bubbles through the nozzle is prevented. When the defective ink jet operation, caused by the entry of air bubbles is eliminated, the failure to print dots is removed and the quality of the resultant print is enhanced accordingly. Since the pressure fluctuation inside the ink chamber subsides more quickly than before, the driving cycle of the ink droplet jet device is heightened and the printing speed is boosted.

These and other objects, features and advantages of the invention will become more apparent upon a reading of the following description in association with the appended drawings.

BRIEF DESCRIPTION OF THE DRAWINGS

A preferred embodiment of the invention will be described in detail with reference to the following figures, wherein:

FIGS. 3(A), 3(B) and 3(C) are timing charts that apply when the ink droplet jet device is in operation;

FIG. 4 is a view portraying how the ink droplet jet device works to jet out ink droplets;

FIG. 5 is a view illustrating how the ink droplet jet device forms an ink droplet;

FIGS. 10(A), 10(B) and 10(C) are timing charts that apply when the conventional shear mode type ink jet printer is in operation;

FIG. 11 is another view showing how the conventional shear mode type ink jet printer works.

DETAILED DESCRIPTION OF THE PREFERRED EMBODIMENT

Figure 6:
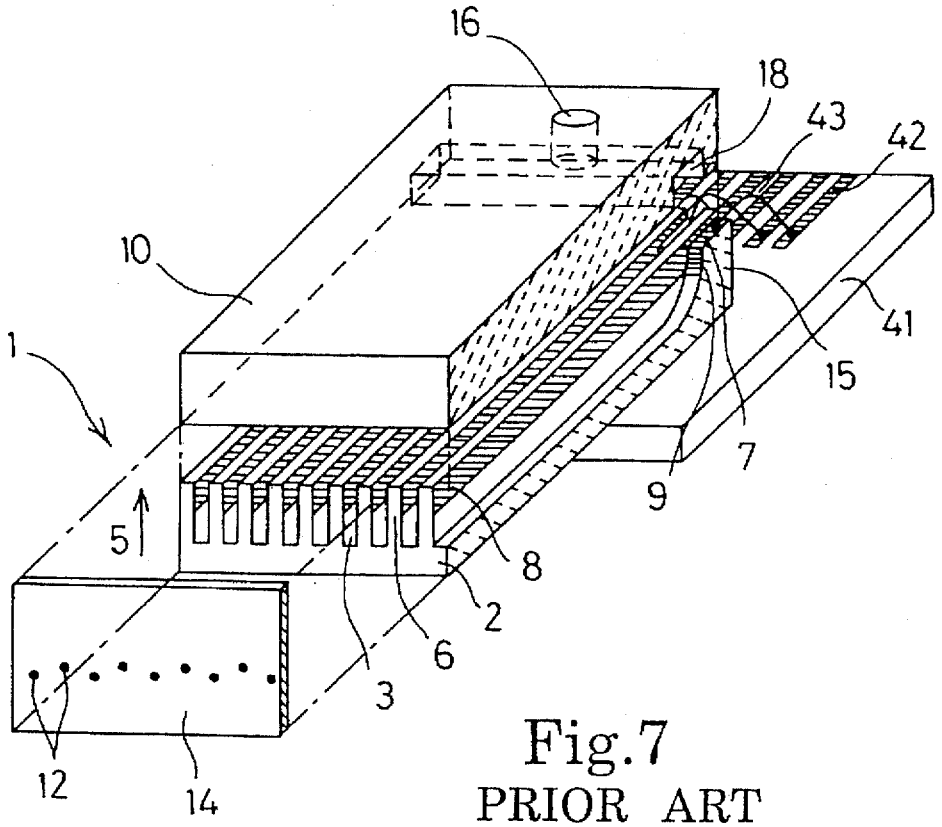
Fig.6 PRIOR ART
FIG. 6 is a perspective view showing a conventional shear mode type ink jet printer.
Figure 7:
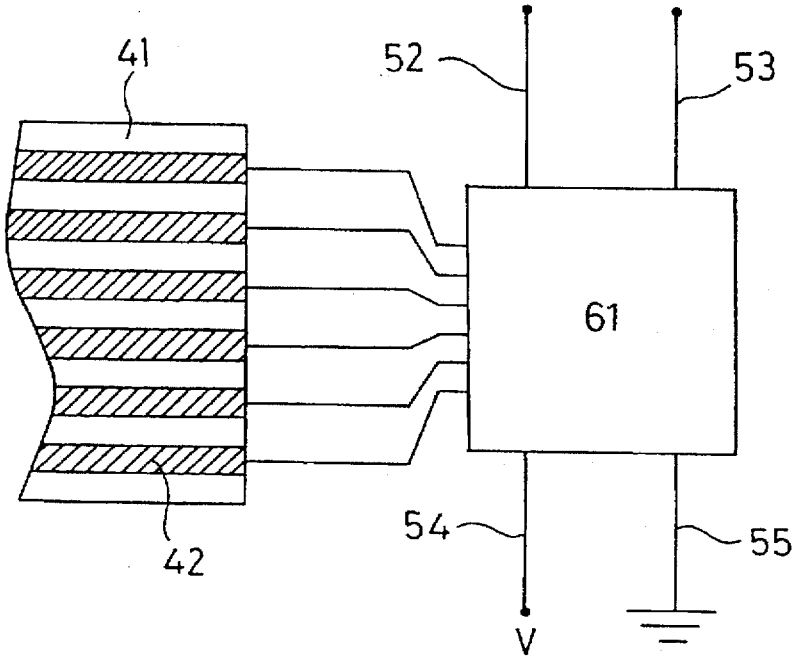
Fig.7 PRIOR ART
FIG. 7 is a block diagram showing a control unit for use in a conventional ink jet printer.
Figure 8:
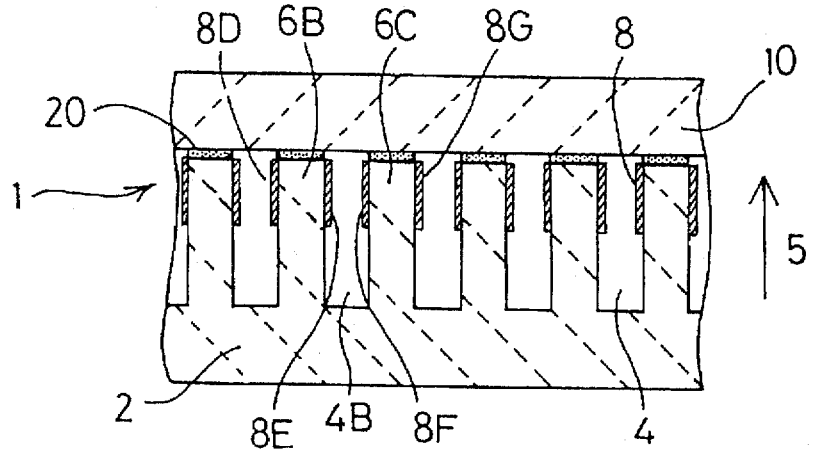
Fig.8 PRIOR ART
FIG. 8 is a cross-sectional view showing the conventional shear mode type ink jet printer.
Figure 9:
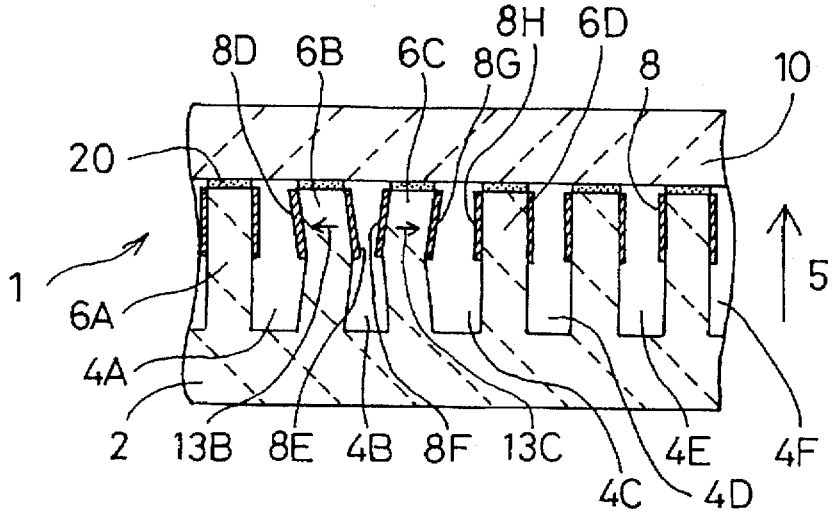
Fig.9 PRIOR ART
FIG. 9 is a view portraying how the conventional shear mode type ink jet printer works.
Figure 12:
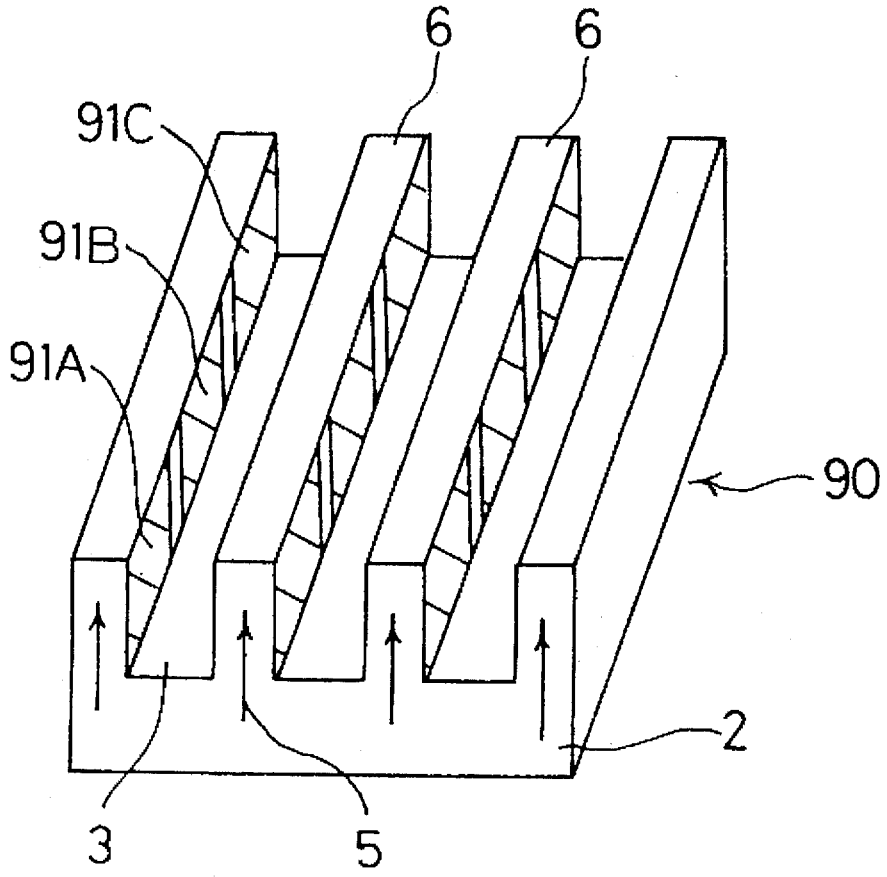
Fig.12 PRIOR ART
FIG. 12 is a view partially depicting another conventional shear mode type ink jet printer.

A preferred embodiment of the invention will now be described with reference to the accompanying drawings. The parts that are identical to those already described in connection with the prior art example are designated by the same reference numbers and any repetitive descriptions of these parts are omitted. The ink droplet jet device embodying the invention is the similar in structure to that shown in FIGS. 6 and 7 except for the directions of polarization of each of the partitions.

Figure 1:
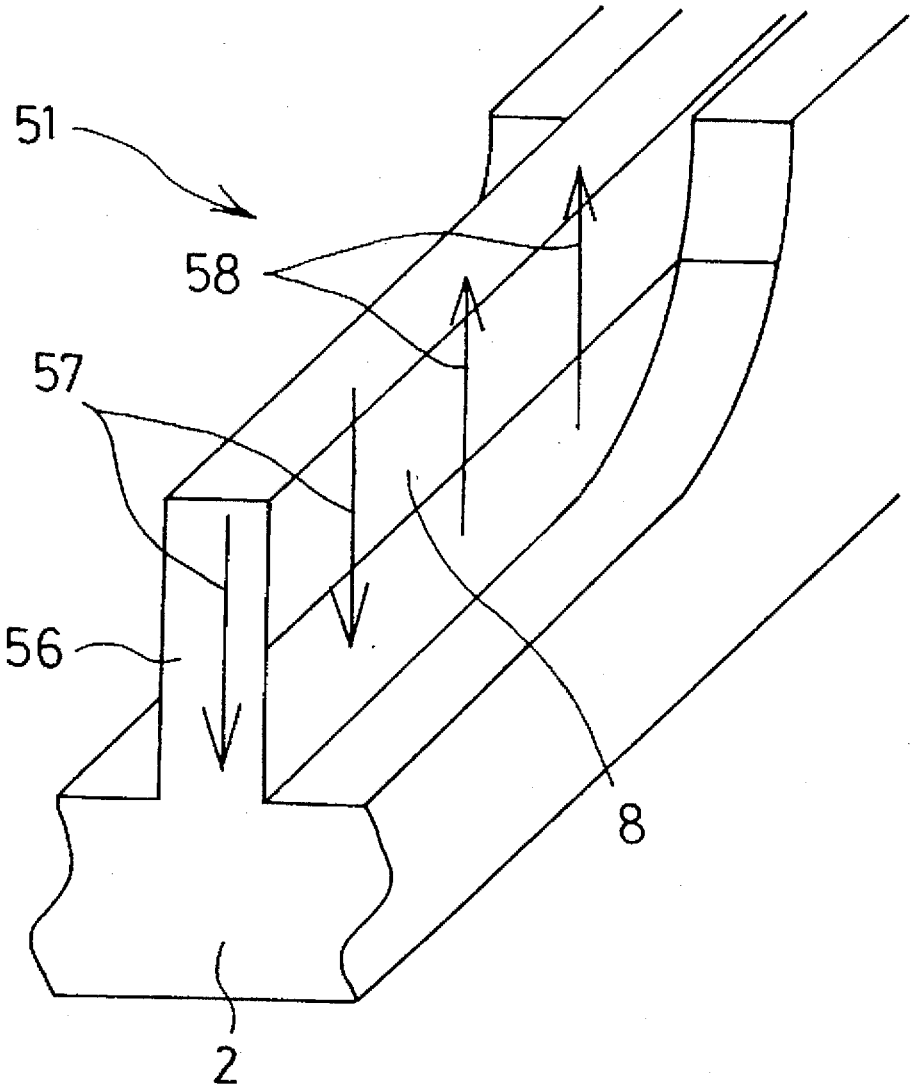
FIG. 1 is a view showing directions of polarization of a given partition in an ink droplet jet device in a preferred embodiment according to the invention.
Figure 2:
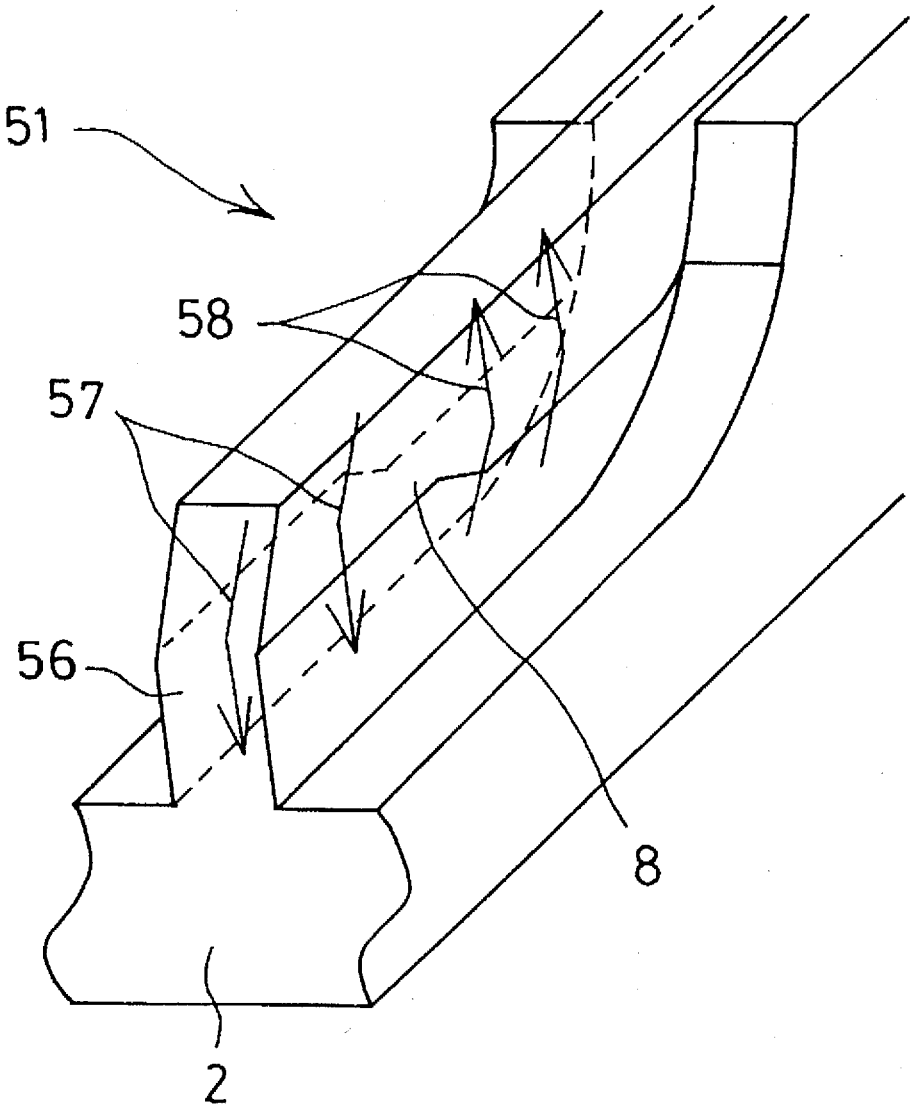
FIG. 2 is a view depicting how each partition of the ink droplet jet device in FIG. 1 typically behaves in operation.

The partitions of the embodiment will be described first. As shown in FIG. 1, the directions 57 and 58 of polarization of a given partition 56 as part of a piezoelectric ceramic plate 2 are opposed to each other across the approximate middle of the partition 56 in the longitudinal direction thereof. That part of the partition 56 polarized in the direction 57 will be called the front half, and that part polarized in the direction 58, the rear half hereunder. The opposite directions of polarization are created by polarizing the front part of the partition 56 with a voltage of one polarity and the rear part thereof with a voltage of the opposite polarity prior to forming the grooves 3. The upper half of the partition 56 is furnished with an electrode 8 formed longitudinally. Applying a voltage to the electrode 8 causes the front and the rear halves thereof to deform in the opposite directions as shown in FIG. 2 because of the directions 57 and 58 of polarization being opposite to each other in the partition 56.

The operation of an ink droplet jet device 51 will be described with reference to FIGS. 3 and 4. A driving voltage pulse F (as shown in FIG. 3(A)) is first applied to the ink chamber 4B (as shown in FIG. 4) to cause ink to be jetted therefrom. At the leading edge of the voltage pulse F, the front half of the partition 56B and that of the partition 56C are deformed to move away from each other, as shown by the solid line in FIG. 4, and the rear halves of the same partitions are deformed to approach each other, as indicated by the broken line in FIG. 4.

At the leading edge of the voltage pulse F, the front halves of the partitions 56B and 56C are deformed so as to generate a negative pressure of ink in the front half portion of the ink chamber 4B; the rear halves of the same partitions are deformed at the same time to generate a positive pressure of ink in the rear half portion of the ink chamber 4B. As depicted in FIG. 3(B), a negative pressure of ink is generated near the nozzle 12 (as shown in FIG. 5) of the ink chamber 4B as a result of the front halves of the partitions 56B and 56C being deformed at the leading edge of the voltage pulse F.

Upon elapse of 0.5 L/a, a positive pressure approaches the nozzle 12 stemming from the rear halves of the partitions 56B and 56C being deformed, the pressure being propagated according to the theory of pressure wave propagation. Since the width of the voltage pulse F is 0.5 L/a, the voltage pulse F drops 0.5 L/a later, and the partitions 56B and 56C return to their initial positions. At this time, the deformed front halves of the partitions 56B and 56C generate a positive ink pressure in the front half portion of the ink chamber 4B, while a negative ink pressure is produced in the rear half portion of the same chamber by the rear halves of the same partitions being deformed. Consequently, upon elapse of 0.5 L/a, the pressure near the nozzle 12 turns out to be a positive pressure P1, i.e., the sum of the previously propagated positive ink pressure and the positive ink pressure generated in the front half portion of the ink chamber 4B by the front halves of the partitions 56B and 56C being deformed at the trailing edge of the voltage pulse F. Thereafter, the pressure near the nozzle 12 of the ink chamber 4B varies at intervals of 0.5 L/a as per the theory of pressure wave propagation. That is, a negative pressure P2 occurs L/a after the leading ledge of the voltage pulse F, followed by a positive pressure P3 upon elapse of 1.5 L/a.

Applying that voltage pulse F to the ink chamber 4B thus triggers the pressure fluctuation near the nozzle 12 of the ink chamber 4B; ink is jetted out through the nozzle 12 by the positive pressures P1 and P3. When the positive pressures P1 and P3 are compared with the positive pressure PB of the comparable prior art pressure waveform shown in FIG. 10(B), it becomes clear that the amplitude is and the total time in which the positive pressures are applied are the same.

It would then be supposed that without the negative pressure P2 of FIG. 3(B), the energy exerted by both the invention and the prior art example to jet ink from the nozzle 12 would be substantially the same and that the ink droplet would be ejected from the nozzle 12 at about the same velocity with about the same volume. What is noticeable here is the presence of the negative pressure P2 between the positive pressures P1 and P3 (as shown in FIG. 3(B)) on the part of the embodiment. The negative pressure P2 appears to suck in the ink droplet being pushed out of the nozzle 12 by the positive pressure P1, apparently causing the letting efficiency to drop appreciably. However, the drop in efficiency of jetting ink need not be significant if the actual state of the ink meniscus is taken into consideration. With the positive pressure P1 (as shown FIG. 3(B)) ended and followed by the negative pressure P2, the ink meniscus is in the state shown in FIG. 5. A head portion 13 of the meniscus is already pushed out of the nozzle 12 by the positive pressure P1 and has a certain velocity. The subsequent occurrence of the negative pressure P2 (FIG. 3(B)) mostly works to choke a neck portion 17 of the meniscus and has little effect in lowering the velocity of the head portion 13. The head portion 13 of the meniscus moves forward by inertia while the neck portion 17 is gradually choked.

Just before or after the neck portion 17 is severed, the pressure near the nozzle 12 again turns positive (positive pressure P3) and again pushes out the ink inside the ink chamber 4B through the nozzle 12. Thereafter, with no positive pressure generated, the meniscus leaves the nozzle 12 to jet out as an ink droplet.

Meanwhile, in the ink chamber 4C adjacent to the ink chamber 4B, the pressure near the nozzle 12 fluctuates as shown in FIG. 3(C). At the leading edge of the voltage pulse F, a positive ink pressure is generated in the front half portion of the ink chamber 4C as a result of the front half of the partition 56C getting deformed, while a negative pressure is produced by the rear half of the same partition 56C getting deformed in the rear half portion of the same ink chamber 4C. At the leading edge of the voltage pulse F, a positive ink pressure develops near the nozzle 12 of the ink chamber 4C due to the front half of the partition 56C getting deformed.

Upon elapse of 0.5 L/a, a negative pressure approaches the nozzle 12 according to the theory of pressure wave propagation, the negative pressure coming from the rear half of the partition 56C getting deformed. Because the voltage pulse F has a width of 0.5 L/a, the voltage pulse F drops 0.5 L/a after the leading edge of the pulse, whereupon the partition 56C returns to its initial position. At this time, a negative ink pressure occurs in the front half portion of the ink chamber 4C due to the front half of the partition 56C getting deformed, while a positive ink pressure develops in the rear half portion of the same ink chamber 56C because of the rear half of the partition 56C getting deformed. Upon elapse of 0.5 L/a, the pressure near the nozzle 12 becomes a negative pressure P11, i.e., the sum of the previously propagated negative pressure and the negative pressure generated in the front half portion of the ink chamber 4C by the front half of the partition 56C getting deformed at the trailing edge of the voltage pulse F. Thereafter, the pressure near the nozzle 12 of the ink chamber 4C varies at intervals of 0.5 L/a as per the theory of pressure wave propagation. That is, a positive pressure P12 occurs upon elapse of L/a after the leading edge of the voltage pulse F, followed by a negative pressure P13 1.5 L/a later.

Applying the voltage pulse F to the ink chamber 4B causes the above-described pressure fluctuation near the nozzle 12 of the ink chamber 4C which is grounded. The negative pressures P11 and P13 combine to retract the ink meniscus inside the nozzle. Without the presence of the positive pressure P12, the total time in which the negative pressure is applied is approximately the same as the negative pressure P10 of the prior art example (FIG. 10(C)), suggesting the possibility that air would be as likely to be introduced into the chamber as before. However, the fact that the positive pressure P12 exists between the negative pressures P11 and P13 in the ink droplet jet device 51 allows the ink meniscus retracted by the negative pressure P11 to return for the moment; the only pressure contributing to introducing air into the ink chamber is the negative pressure P13. Since the negative pressure P13 lasts only for the period of 0.5 L/a, the amount of the meniscus getting retracted into the ink chamber 4C is reduced significantly and the entry of air into the chamber 4C is prevented accordingly.

What takes place in ink chamber 4A, also adjacent to the ink chamber 4B, is the same as in ink chamber 4C.

When a plurality of voltage pulses F are applied to the ink chamber 4B at a suitable timing, a plurality of ink droplets are jetted from the ink chamber 4B. The total amount of jetted ink is thus varied as desired so that a desired gradation of printing is made available.

The ink droplet jet device 51 of the above-described structure is characterized by the opposite directions 57 and 58 of polarization in the front and the rear halves of each partition 56. When a voltage is applied to a given partition 56, the front and the rear half thereof are deformed in the opposite directions. Thus, the ink pressure near the nozzle 12 of the target ink chamber 4B varies at intervals of 0.5 L/a. To use the pressure fluctuation for jetting ink requires first applying a voltage pulse F having a width of 0.5 L/a to the partitions 56B and 56C of the ink chamber 4B. The leading and trailing edges of the voltage pulse F cause the front and rear halves of the partitions 56B and 56C to deform. The combined pressure stemming from the deformed front and rear halves of the partitions 56B and 56C jets ink from the ink chamber 4B. At this point, the pressure near the nozzle 12 of the adjacent grounded ink chamber 4C also varies at intervals of 0.5 L/a. That is, the negative pressures P11 and P13 are generated to retract the ink meniscus while the positive pressure P12 occurs between the two negative pressures. The meniscus is retracted by the negative pressure P11, pushed back by the positive pressure P12, and again retracted by the negative pressure P13. But since the negative pressure P13 lasts only 0.5 L/a, the amount of the meniscus retracted thereby is limited and the entry of air into the ink chamber 4C is forestalled.

The electrodes 8 are arranged uniformly over the partitions 56 in the longitudinal direction thereof. This structure makes it easy to form the electrodes 8 in the manufacturing stage.

As described, applying the voltage pulse F having the width of 0.5 L/a to the partitions 56B and 56C of the ink chamber 4B causes the partitions to deform and exert ink pressure therein. The pressure change jets ink from the ink chamber 4B and subsides 2.5 L/a later. This connotes that the pressure fluctuation in a given ink chamber of the embodiment subsides 0.5 L/a earlier than in the comparable conventional setup. The driving frequency of the ink droplet jet device 51 is enhanced correspondingly, whereby the printing speed is improved.

Although the description above contains many specifics, these should not be construed as limiting the scope of the invention but as merely providing illustrations of the presently preferred embodiment according to the invention. For example, although the embodiment has the directions 57 and 58 of polarization opposed across the middle of each partition 56 in the longitudinal direction thereof, the polarity-reversed location need not be at the midpoint. Alternatively, the location where the directions 57 and 58 of polarization are opposed to each other may be shifted so as to adjust the pressure waveforms of FIGS. 3(B) and 3(C) as needed. In this manner, different types of ink having different characteristics may be handled so as to ensure optimum printing performance and to minimize the possible entry of air bubbles into the ink chambers.

Another alternative may involve having different intensities of polarization in the directions 57 and 58, whereas the above embodiment keeps the same intensity of polarization in the directions 57 and 58 that are opposed across the longitudinal middle of each partition 56. Varying the intensities of polarization in any of the directions 57 and 58 of each partition 56 makes it possible to adjust the pressure waveforms of FIGS. 3(B) and 3(C). This also ensures optimum printing performance and minimizes the possible entry of air bubbles into the ink chambers regardless of the use of different types of ink having different characteristics.

A further alternative may involve splitting each partition 56 into three or more parts of different polarities instead of the front and the rear half adopted for the above embodiment.

Thus the scope of the invention should be determined by the appended claims and their legal equivalents, rather than by the examples given.

What is claimed is:

1. An ink droplet jet device, comprising:

a first plate having a plurality of grooves formed therein, said grooves being separated by partitions having a longitudinal axis, at least a part of said partitions made of polarized piezoelectric elements, wherein each of said partitions has at least two segments having different directions of polarization of said pizoelectric elements sequentially along the longitudinal axis of said partitions and each partition has an upper surface;

a second plate attached to said first plate at the upper surface of each said partition of the partitions to enclose the grooves to form ink chambers of the enclosed grooves; and a nozzle plate having nozzles formed therein so as to correspond to said ink chambers, wherein said partitions have electrodes formed thereon, said electrodes extending along the longitudinal axis of said partitions and being used to cause said partitions to deform in opposite directions at adjacent segments such that pressure waves generated in ink within the ink chambers at different segments of the partitions combined phases near the nozzles.

2. The ink droplet jet device according to claim 1, wherein said at least two segments are equal in length in the longitudinal direction of said partitions.

3. The ink droplet jet device according to claim 1, wherein said at least two segments have different lengths in the longitudinal direction of said partitions.

4. The ink droplet jet device according to claim 1, wherein the direction of polarization of one segment of a given partition polarized in one direction differs by 180° from the direction of polarization of another segment of the same partition polarized in another direction.

5. The ink droplet jet device according to claim 1, wherein said electrodes are formed on said partitions which have at least two segments having different directions of polarization of the piezoelectric elements sequentially along the longitudinal direction of the partitions.

6. An ink ejecting device, comprising:

a base plate having a plurality of grooves formed therein to define ink channels, and walls on either side of said grooves forming partitions, said partitions having a longitudinal axis and each partition having a top surface;

a cover plate mounted to the top surface of each said partition; and a nozzle plate having an orifice to correspond to each ink channel of said plurality of ink channels, wherein each said partition comprises a first portion and a second portion positioned sequentially along the longitudinal axis, said first portion polarized in a direction rotated 180° from a direction of polarization of said second portion; and an electrode on at least an upper half of each said partition and extending along the longitudinal axis of said partition, wherein said first portion and said second portion of each said partition deform in opposite directions in use such that a cycle of pressure fluctuation near said orifice is shortened.

7. The ink ejecting device as claimed in claim 6, further comprising a power source for applying a current to each said electrode of an ink channel to cause ejection of an ink drop.

8. The ink ejecting device as claimed in claim 6, wherein said first portion and said second portion are of substantially the same length.

9. The ink ejecting device as claimed in claim 6, wherein a degree of polarization of said first portion and said second portion are substantially equal.

10. The ink ejecting device according to claim 6, further comprising an electrode formed on each partition which has the first portion and the second portion with directions of polarization rotated 180 degrees positioned sequentially along the longitudinal axis of the partitions.

11. An ink ejecting device, comprising:

a base plate, at least a part of said base plate made of a piezoelectric material;

a plurality of walls extending from a surface of said base plate, each pair of adjacent walls of said plurality of walls defining a groove therebetween, each of said walls having a longitudinal axis and said piezoelectric material exists in each wall of said plurality of walls;

an electrode on at least an upper half of said each wall of said plurality of walls and extending along the longitudinal axis of said each wall of said plurality of walls;

a cover plate mounted to upper surfaces of said plurality of walls to enclose each groove to define a plurality of ink chambers thereby; and a nozzle plate mounted to an end of said base plate and said cover plate, said nozzle plate having an orifice for each ink chamber, wherein said each wall of said plurality of walls has a first portion and a second portion sequentially positioned along said longitudinal axis, said first portion having a first direction of polarization and said second portion having a second direction of polarization, said first direction of polarization and said second direction of polarization being different from one another, wherein adjacent portions of each said wall deform in opposite directions in use such that a cycle of pressure fluctuation near the orifice of the ink chamber is shortened.

12. The ink ejecting device a claimed in claim 11, wherein said piezoelectric base plate and said plurality of walls are an integral structure.

13. The ink ejecting device as claimed in claim 11, wherein said first direction of polarization and said second direction of polarization are rotated 180° from one another.

14. The ink ejecting device as claimed in claim 11, wherein said first portion and said second portion are of substantially the same length.

15. The ink ejecting device as claimed in claim 11, wherein a degree of polarization of said first portion and said second portion are substantially equal.

16. The ink ejecting device as claimed in claim 11, further comprising a power source for applying a current to said electrodes of an adjacent pair of walls defining an ink channel to cause ejection of an ink drop.

17. The ink ejecting device according to claim 11, wherein said electrode is formed on said each wall which have the first portion and the second portion sequentially positioned along the longitudinal axis with the first portion having the first direction of polarization and the second portion having the second direction of polarization.

* * * * *